US009407979B2

(12) United States Patent
Yamada

(10) Patent No.: US 9,407,979 B2
(45) Date of Patent: Aug. 2, 2016

(54) LOUDSPEAKER

(71) Applicant: ZORZO CO., LTD., Tokyo (JP)

(72) Inventor: Teppei Yamada, Tokyo (JP)

(73) Assignee: ZORZO CO., LTD., Tokyo (JP)

( * ) Notice: Subject to any disclaimer, the term of this patent is extended or adjusted under 35 U.S.C. 154(b) by 0 days.

(21) Appl. No.: 14/677,003

(22) Filed: Apr. 2, 2015

(65) Prior Publication Data

US 2015/0304748 A1 Oct. 22, 2015

(30) Foreign Application Priority Data

Apr. 17, 2014 (JP) ..... 2014-002010 U

(51) Int. Cl.
*H04R 1/02* (2006.01)
*H04R 1/28* (2006.01)

(52) U.S. Cl.
CPC ..... *H04R 1/02* (2013.01); *H04R 1/2803* (2013.01); *H04R 1/2869* (2013.01); *H04R 1/2888* (2013.01); *H04R 2400/11* (2013.01)

(58) Field of Classification Search
CPC ..... H04R 1/02; H04R 1/025; H04R 1/227; H04R 1/2803; H04R 1/2807; H04R 1/2811; H04R 1/2819; H04R 1/2823; H04R 1/2826; H04R 1/2846; H04R 1/2849; H04R 1/2853; H04R 1/2857; H04R 1/2869; H04R 1/2884; H04R 1/2888; H04R 3/12
See application file for complete search history.

(56) References Cited

U.S. PATENT DOCUMENTS 2,768,702 A * 10/1956 Lowry ..... H04R 1/227 381/182
3,892,288 A * 7/1975 Klayman ..... H04R 1/2849 181/156
4,268,719 A * 5/1981 Manger ..... H04R 1/02 181/144
4,466,505 A * 8/1984 Ritter ..... H04R 1/227 181/144

(Continued)

FOREIGN PATENT DOCUMENTS

| | | |
|---|---|---|
| EP | 2 475 191 | 7/2012 |
| JP | 02-100500 | 4/1990 |
| JP | 2007-235727 | 9/2007 |

OTHER PUBLICATIONS

Extended European Search Report issued Jul. 9, 2015 in corresponding European Patent Application No. 15162448.3.

*Primary Examiner* — Curtis Kuntz
*Assistant Examiner* — Joshua Kaufman
(74) *Attorney, Agent, or Firm* — Wenderoth, Lind & Ponack, L.L.P.

(57) ABSTRACT

A loudspeaker includes a hermetically-sealed enclosure, a first driver arranged at outside of the enclosure and along a wall of the enclosure, a second driver arranged at inside of the enclosure and parallel to the first driver across the wall of the enclosure from the first driver, and a pipe communicating the first driver and the second driver. Each of the drivers has a diaphragm, and a frame surrounding the diaphragm. The frame has an opening. The pipe is connected to the opening of the frame of the first driver, penetrates through the wall of the enclosure, and is connected to the opening of the frame of the second driver, and thereby forming one hermetically-sealed space enclosed with the diaphragms and the frames of the two drivers. The second driver is configured to output a signal of opposite phase to that of the first driver.

3 Claims, 1 Drawing Sheet

(56) References Cited

U.S. PATENT DOCUMENTS 4,598,789 A * 7/1986 Ritter ..... H04R 1/227 181/144
4,783,820 A * 11/1988 Lyngdorf ..... H04R 1/227 181/145
4,799,264 A * 1/1989 Plummer ..... H04R 1/023 181/145
5,073,945 A * 12/1991 Kageyama ..... H04R 1/227 381/184
5,323,466 A * 6/1994 Geddes ..... F01N 1/065 381/412
6,031,919 A * 2/2000 Funahashi ..... H04R 1/2842 181/145
6,359,997 B2 * 3/2002 Geisenberger ..... H04R 9/025 381/401
6,431,309 B1 * 8/2002 Coffin ..... H04R 1/2819 181/145
6,678,384 B2 * 1/2004 Kowaki ..... H04R 1/2896 181/144
6,985,593 B2 * 1/2006 Nichols ..... B60R 11/0217 181/145
7,062,054 B2 * 6/2006 Nishikawa ..... H04R 1/227 381/182
7,068,806 B2 * 6/2006 Walsh ..... H04R 9/06 381/345
7,454,025 B2 * 11/2008 Saiki ..... H04R 1/2819 381/161
7,551,749 B2 * 6/2009 Rosen ..... B60R 11/0217 381/186
8,180,076 B2 * 5/2012 Bastyr ..... H04R 1/2888 381/182
2012/0177218 A1 * 7/2012 Yamada ..... H04R 3/02 381/89
2014/0328491 A1 * 11/2014 Slotte ..... H04R 1/2811 381/74
2014/0348349 A1 * 11/2014 Nagaoka ..... H04R 1/288 381/162
2015/0304748 A1 * 10/2015 Yamada ..... H04R 1/2803 381/394

* cited by examiner

LOUDSPEAKER

BACKGROUND OF THE INVENTION

1. Technical Field

The present invention relates to a loudspeaker which enables to faithfully reproduce original sound from media resource.

2. Background Art

In conventional enclosure-type or cabinet-type loudspeakers, a problem of back pressure of a driver is difficult to avoid. Only one solution to avoid it is to use a flat baffle plate. But an enormous flat baffle plate is required to configure a perfect loudspeaker by using a flat baffle plate. So, it has a fault in practical use.

A loudspeaker 10 illustrated in FIG. 2 employs a tandem drive system. The loudspeaker 10 is double enclosure type, having one enclosure 11*a* and a driver 12*a*, and another enclosure 11*b* and a driver 12*b* behind them. This is put into practical use by EgglestonWorks. In this, a diaphragm 13*b* of the rear driver 12*b* moves simultaneously in the same phase as a diaphragm 13*a* of the front driver 12*a* moves forward. It is said that this makes pressure in the front loudspeaker box always same as an outside pressure, and thereby the problem of back pressure of the diaphragm is resolved.

However, this system does not produce desired effect. The reason is that air moves slowly, air compresses and expands easily, and thereby the front diaphragm 13*a* begins to move before air delivered by the driver 12*b* arrives behind the front driver 12*a*. Therefore, a fundamental solution of the problem of back pressure is not achieved. This results that part of electric energy is not converted to vibrational energy of air, and becomes energy moving the driver and therefore the entire loudspeaker. Thus, a problem remains in accuracy of reproduced sound.

SUMMARY OF THE INVENTION

The present invention aims to solve the above-mentioned problem. That is, the present invention aims to cancel reaction of the diaphragm, and to remove the problem of back pressure of the loudspeaker.

A loudspeaker according to the present invention has a hermetically-sealed enclosure, a first driver arranged at outside of the enclosure and along a wall of the enclosure, a second driver arranged at inside of the enclosure and parallel to the first driver across the wall of the enclosure from the first driver, and a pipe communicating the first driver and the second driver. Each of the drivers has a diaphragm and a frame surrounding the diaphragm. The frame has an opening. The pipe is connected to the opening of the frame of the first driver, penetrates through the wall of the enclosure, and is connected to the opening of the frame of the second driver, and thereby forming one hermetically-sealed space enclosed with the diaphragms and the frames of the two drivers. The second driver is configured to output a signal of opposite phase to that of the first driver.

The frame may have a second opening, and a cover member may stem the second opening.

The pipe may communicate the two drivers in the shortest distance.

In the loudspeaker according to the present invention, the two drivers are adjacent in the shortest distance, and the pipe communicating between the openings of the frames of the two drivers connects the frames of them, forming the hermetically-sealed space. Therefore, the space connecting the drivers is very small, and thereby the two drivers operate in exact synchronization with tight motion relation. This improves resonant frequency Fo of the drivers connected by the pipe, and achieves open and clear reproduced sound.

DESCRIPTION OF THE PREFERRED EMBODIMENTS

Figure 1:
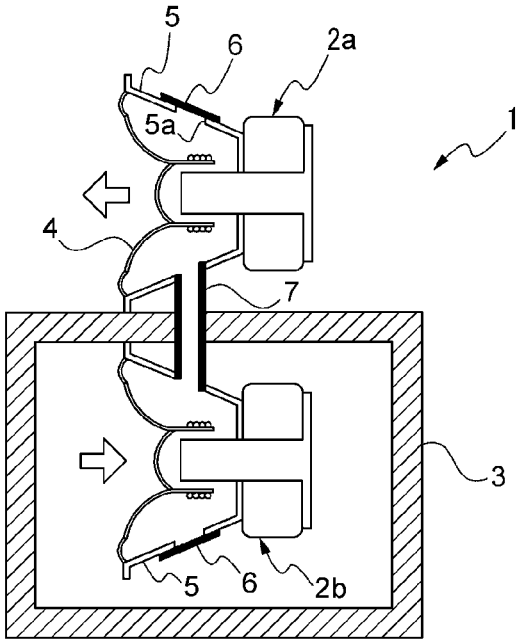
FIG. 1 shows a vertical cross-sectional view of a loudspeaker of an example of the present invention.
Figure 2:
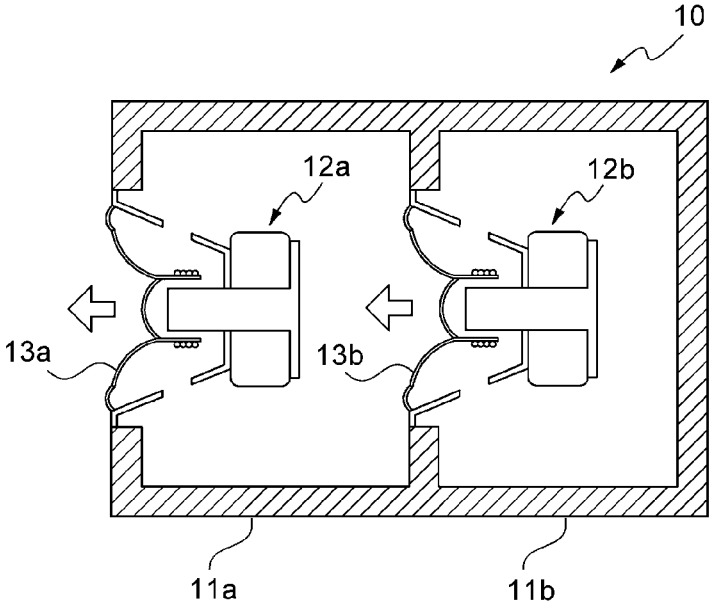
Fig. 2 PRIOR ART
FIG. 2 shows a vertical cross-sectional view of a loudspeaker of a related art.

As shown in FIG. 1, a loudspeaker 1 of an example of the present invention has a enclosure 3 having a box shape and hermetically sealed at six faces, a driver 2*a* arranged at outside of the enclosure 3 and along a wall of an upper face, or a top plate, of the enclosure 3, a driver 2*b* arranged at inside of the enclosure 3 and parallel to the driver 2*a* across the wall of the upper face of the enclosure 3 from the driver 2*a*, and a pipe 7 communicating the driver 2*a* and the driver 2*b* in the shortest distance.

Each of the drivers 2*a* and 2*b* has frame 5 surrounding a diaphragm 4, and a cover member 6 stemming an opening 5*a* of the frame 5. On the frame 5, plural openings 5*a* are formed. The pipe 7 is connected to one of the openings 5*a* of the driver 2*a*, penetrates through the wall of the upper face of the enclosure 3, and is connected to one of the openings 5*a* of the driver 2*b*. The cover members 6 stem all openings 5*a* except the openings 5*a* connected to the pipe 7.

The cover members 6 stemming the other openings 5*a* of the frame 5 than the openings 5*a* connected to the pipe 7 forms a hermetically-sealed space communicated by the pipe 7 among the diaphragms 4 and the frames 5 of the drivers 2*a* and 2*b*. The pipe 7 is, for example, plastics, and is stuck to the drivers 2*a* and 2*b* by epoxy-based adhesive. But the pipe 7 may be formed of other materials as far as it has high airtightness and is hardly deformable.

The driver 2*a*, arranged at outside of the enclosure 3, reproduces a sound signal recorded on a media resource, such as CD, faithfully as it is. The driver 2*b*, arranged at inside of the enclosure 3, reproduces a sound signal having opposite phase to that reproduced by the driver 2*a*. Thus, when the diaphragm 4 of the driver 2*a* is driven to a direction as shown by the left-directed arrow in the figure, the diaphragm 4 of the driver 2*b* is driven to an opposite direction to that of the driver 2*a*, as shown by the right-directed arrow in the figure.

Since the loudspeaker 1 is configured as described above, sonic vibration generated at a back side of the diaphragm 4 of the driver 2*a* is canceled by sonic vibration having opposite phase generated from the driver 2*b*. In other words, sound as well as air pressure disappears by mutually canceling in the hermetically-sealed space communicated by the pipe 7. Therefore, the driver 2*a* can faithfully reproduce a sound signal recorded on the media resource without bad influence of reaction and back pressure of the diaphragm 4.

The loudspeaker according to the present invention can faithfully reproduce a sound signal recorded on a media resource, and can be widely used as an audio equipment.

A resonant frequency Fo reduced by about 20% according to inventor's experiment. Improving Fo makes enable to produce a full-range loudspeaker with small diameter.

Various modifications and changes may be applied to the above-described embodiments. This can be readily appreciated by a person skilled in the art. The present invention is not limited to the above-described embodiments, and includes modified and/or changed ones, without departing from a scope defined by the appended claims.

What is claimed is:

1. A loudspeaker, comprising:

a hermetically-sealed enclosure;

a first driver arranged along a wall of the enclosure outside of the enclosure;

a second driver arranged parallel to the first driver across the wall of the enclosure from the first driver inside of the enclosure; and a pipe communicating the first driver and the second driver, wherein each of the drivers has a diaphragm, and a frame surrounding the diaphragm, each of the frames has an opening at a side facing the wall of the enclosure, the pipe is connected to the opening of the frame of the first driver, penetrates through the wall of the enclosure, and is connected to the opening of the frame of the second driver, thereby forming one hermetically-sealed space enclosed with the diaphragms and the frames of the two drivers, and the second driver is configured to output a signal of opposite phase to that of the first driver.

2. The loudspeaker of claim 1, wherein each of the frames has a second opening, and a cover member stems the second opening.

3. The loudspeaker of claim 1, wherein the pipe communicates the two drivers in the shortest distance.

* * * * *